United States Patent [19]

Krüger et al.

[11] B 3,990,244

[45] Nov. 9, 1976

[54] CONTROL SYSTEM FOR STEAM FLOWRATE AND STEAM PRESSURE

[75] Inventors: Karl-Heinz Krüger, Witten; Reinhard Altfelder, Dortmund-Mengede, both of Germany

[73] Assignee: Friedrich Uhde GmbH, Dortmund, Germany

[22] Filed: Mar. 7, 1975

[21] Appl. No.: 556,496

[44] Published under the second Trial Voluntary Protest Program on March 16, 1976 as document No. B 556,496.

[30] Foreign Application Priority Data

Mar. 16, 1974 Germany ..... 2412804

[52] U.S. Cl. ..... 60/660

[51] Int. Cl.[2] ..... F01K 13/02

[58] Field of Search ..... 60/660; 415/26, 30, 415/47

[56] References Cited

UNITED STATES PATENTS 3,811,279 5/1974 Vogeli ..... 60/660

FOREIGN PATENTS OR APPLICATIONS 463,202 3/1968 Japan ..... 60/660

*Primary Examiner*—Allen M. Ostrager
*Attorney, Agent, or Firm*—Malcolm W. Fraser

[57] ABSTRACT

A system for holding a substantially constant pressure level in the medium pressure steam system of an integrated plant, despite any sudden shutdown of a high pressure steam turbine. A combination quick-opening and a control valve is provided with a hold-down operator and positioning actuator with a spring drive, the hold-down operator being connected through a changeover valve with a working pressure system. The positioning actuator is connected to an additional change-over valve and to the outlet of the pressure controller, such additional change-over valve being provided with a connecting line to the outlet of the pressure controller and to the outlet of a multiplier relay. The two change-over valves are actuated through the turbine trip system. The combination quick-opening and control valve has an operating lever mounted on a fixed fulcrum pivoted on the piston rod of another pneumatic drive. Alternatively, the operating lever for the combination quick-opening and control valve is pivoted centrally thereof to the valve stem and the two arms of the lever are connected respectively to the hold-down operator and the positioning actuator with their change-over valves.

3 Claims, 2 Drawing Figures

CONTROL SYSTEM FOR STEAM FLOWRATE AND STEAM PRESSURE

BACKGROUND OF THE INVENTION

The present invention relates to a control system for steam flowrate and steam pressure in the interconnecting line between a high-pressure and a medium-pressure steam line, said interconnecting line being a bypass line in a steam system that incorporates steam turbines. Control systems of this kind are widely used as constituent parts of steam systems in the chemical industries and comprise substantially a combination quick-opening and control valve, a flowmeter with root-extracting and multiplier relays installed on the feed-stream line to the steam turbines, and a pressure controller installed on the line of the lower pressure rating.

Control systems for steam flowrate and steam pressure are intended to serve as a plant safety element in integrated industrial chemical plants to prevent damage in the event of a sudden failure of steam consumers, such as steam turbines or chemical processes.

Production processes in industrial chemical plants, such as ammonia and ethylene plants, release process heat at high temperature levels while steam of a certain definite pressure level is needed as auxiliary fluid for various chemical reactions. In addition, these plants require motive power for compressors, pumps or alternators. Because of these conditions and requirements, it is reasonable to utilize the process heat for steam-raising at high pressure, to expand the high-pressure steam in back pressure steam turbines for reducing its pressure to the process steam pressure level while obtaining motive power for compressors, pumps or alternators, and then to admit the process steam as auxiliary fluid from the medium pressure steam system to the process stages where steam is needed.

Plants designed along this concept are generally referred to as integrated plants. They usually comprise a high pressure turbine whose exhaust steam is sent to the medium pressure steam ling. The characteristics of the product obtained from chemical reactions by admixing steam as auxiliary fluid depend on the steam flowrate not only with regard to product quantity but particularly with regard to product composition, i.e. on a constant flow ratio of steam to starting material. A constant pressure level is required for process economy because a major part of the processes applied today is performed at an elevated pressure of 20 to 80 atm. g., for example, and the process yield is frequently conditional upon the pressure, i.e. the rate of conversion decreases as the pressure drops. In addition, the process steam admitted to the catalyst-filled reforming tubes exposed to external firing for the production of synthesis gas is expected to maintain a constant temperature level, i.e. in the event of a failure of the steam supply and exposure of the tubes to radiation heat, the outside wall temperature of the reforming tubes would be subject to overheating with consequent damage to the catalyst.

It is known that steam turbines are equipped with an emergency trip on the steam line to safeguard immediate interruption of the steam supply in the event of a failure. Any response of the emergency trip entails necessarily an interruption of the steam supply to the medium pressure steam line. As the steam consumers connected to this line are not at the same time shut down immediately, said consumers being either further steam turbines or process stages, the steam pressure is bound to break down at these points with consequent shutdown of the entire plant as a result of the response of the process steam ratio controller.

According to German Patent OS 1,927,509, it is known to prevent an excessive pressure drop in the medium pressure line with the aid of a steam pressure reducing valve with a quick opening device on a bypass line to the feedline of a steam turbine, i.e. between the high pressure line and the medium pressure line. The known steam pressure reducing valve with a quick opening device appears to satisfy the requirements with regard to change-over times and maintaining steam flowrates and steam pressure levels in a prime mover facility comprising steam turbines of high pressure, medium pressure, and low pressure ratings. Any transient reduction of the steam flowrate in medium pressure and low pressure steam turbines will entail solely a reduction of the output, but will not cause the materials of construction of the engine to be exposed to higher stresses. The known devices are, however, not adequate to meet the requirements that must be satisfied by a control system intended to ensure the change-over in an industrial chemical plant comprising an integrated steam system. The steam from the medium pressure system of such a plant is used, for example, in further steam turbines and, among other purposes, serves as process steam in fired tubular reactors for the cracking of hydrocarbons. Referring, for example, to an ammonia synthesis plant for the production of 1,000 tons/day of $NH_3$, the medium pressure system of the plant, including superheater, has a volume of approximately 10 $m^3$ and, therefore, contains approximately 100 kg of steam at a specific steam volume of 0.1 $m^3$/kg. As steamrequirements of consumers connected to the medium pressure system of such a plant amount to approximately 150 tons/hr. or approximately 42 kg/sec., the steam pressure will drop within as short a time as one second from the moment of steam supply failure to approximately 50% of its setpoint value. This significant pressure drop and steam shortage will cause an emergency shutdown of the entire plant and overheating of the reforming tubes exposed to external firing.

SUMMARY OF THE INVENTION

The object of the invention is to provide a method for holding a substantially constant pressure level in the medium pressure steam system of an integrated plant despite any sudden shutdown of a high pressure steam turbine and, consequently, for safeguarding a sufficient process steam flowrate at any time.

According to the invention, the problem is solved by providing the combination quick-opening and control valve with a hold-down operator and a positioning actuator with spring drive, the hold-down operator being connected through a change-over valve with a working pressure system, the positioning actuator being connected to an additional change-over valve and to the outlet of the pressure controller, the additional change-over valve being provided with a connecting line to the outlet of the pressure controller and to the outlet of the multiplier relay, and the two change-over valves being actuated through the turbine trip system.

In order to permit the control system according to the invention to be employed also as a start-up aid, it is another feature of the invention that the fixed fulcrum of the valve operating lever of the combination quick-opening and control valve is pivoted on the piston rod of another pneumatic drive.

Referring to an integrated plant that comprises more than one high pressure turbine and requires the steam supply to the medium pressure steam system to be maintained even after a sudden shutdown of one or more high-pressure steam turbines, it is another feature of the invention that the control system is designed for the valve operating lever to be pivoted to the center of the valve stem while the two lever arms are connected to the hold-down operator and the positioning actuator with their change-over valves, respectively.

It is an essential feature of the invention that the multiplier relay is connected through the change-over valve and the outlet line of the pressure controller to the positioning actuator of the combination quick-opening and control valve. This design permits a control pressure from the pressure controller to be present at the second inlet of said change-over valve, said control pressure being equal to the control pressure which is conditional upon the steam flowrate. Therefore, the positioning actuator will not receive a different impulse from the pressure controller at the moment of opening of the combination quick-opening and control valve. The valve will not be subject to hunting.

The invention offers the particular advantage that the connection of the flowmeter installed on the steam feedline to the turbine and the connection of the pressure controller installed on the medium pressure line to the combination quick-opening and control valve permits and instantaneous change-over of the flow of high pressure steam into the medium pressure steam system without producing any inadmissible pressure variations in the medium pressure steam system. The medium pressure steam system can be considered as being closely tied-in to the high pressure steam system. The steam shortage in the reaction tubes of the reforming plant for the production of synthesis gas that has so far been a major risk affecting plant safety can no longer occur. The overall plant can be held in operation even after a failure of one or more steam turbines that are connected to the high pressure steam line.

DESCRIPTION OF PREFERRED EMBODIMENTS

Figure 1:
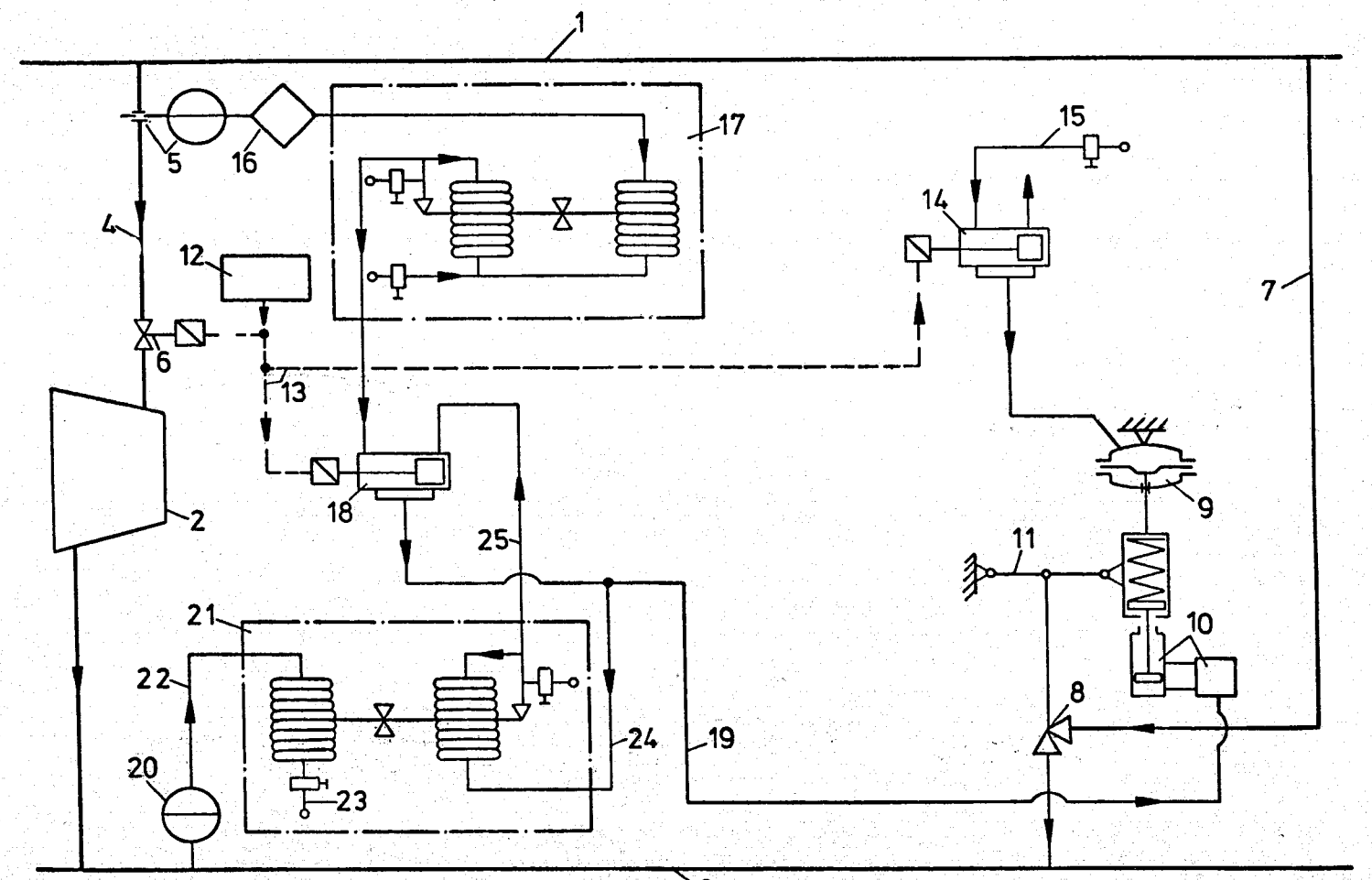
FIG. 1 is a simplified functional diagram of the control system applied to a single-turbine facility, with the combination quick-opening and control valve in the working position.

Referring to FIG. 1, the steam passes from a high pressure steam line 1 through a feed line 4 and a high pressure steam turbine 2 into a medium pressure steam line 3 from where it is diverted to further prime movers and to process stages. Steam feedline 4 for the high pressure turbine 2 comprises a flowmeter 5 and an emergency trip 6. Bypass line 7 with a combination quick-opening and control valve 8 is connected in parallel to the turbine 2. This line serves for diverting and reducing the rated steam flow from the high pressure steam line 1 to the medium pressure steam line 3, if and when required. This rated steam flow is equivalent to the steam flow passing through the line 4 and turbine 2.

In the working position, the combination quick-opening and control valve 8 remains closed because of the force applied to an hold-down operator 9. The force applied to the hold-down operator 9 of the combination quick-opening and control valve 8 exceeds the force applied to a positioning actuator 10; consequently, the valve disk is held on its seat through a unilaterally fixed operating lever 11. The positioning impulse emitted from a turbine trip system 12 has displaced the piston of a change-over valve 14 through an impulse line 13 to such an extent that the control air pressure from line 15 becomes operative on the hold-down operator 9 of the combination quick-opening and control valve 8. The force applied to the positioning actuator 10 depends for its actual value on the flowmeter 5 with subsequent transformation through a root extracting relay 16, multiplier relay 17 and a change-over valve 18.

In the working position, the piston of change-over valve 18 is displaced through a setting impulse from turbine trip system 12 via the impulse line 13 to permit the control impulse from the flowmeter 5 to be sent through a line 19 to the positioning actuator 10 of the combination quick-opening and control valve 8. The magnitude of this control impulse effects a proportional initial stress on the spring of the positioning actuator 10.

Medium pressure line 3 is connected to a pressure transmitter 20 with a pressure controller 21. Pressure controller 21 is provided with connections 22, 23, 24, and 25. In the working position, the bellows system of pressure controller 21 is in a force-balance state in that the set-point value adjusted through the line 23 is equal to the actual value imposed from the pressure transmitter 20 through the line 22. Consequently, a force balance state is necessarily achieved in the opposite bellows system because the control impulse in the line 25 is equal to the impulse in the line 24.

If the system working position as described above is disturbed by a turbine failure which makes the turbine trip system operative with consequent sudden closing of the emergency trip 6, a sequence of change-over operations will take place as follows.

The turbine trip system will actuate the change-over valves 14 and 18 to shift their working pistons into the opposite position. In the change-over valve 14, the control air flow to the hold-down operator 9 is stopped, the discharge of the fluid acting upon the hold-down operator is opened with consequent release of the hold-down operator and the proportional initial stress of the spring of positioning actuator 10 becomes operative to open the combination quick-opening and control valve 8 to the extent required to ensure the passage of the set-point flowrate of steam.

At the same time, the control path in change-over valve 18 has been closed against flowmeter 5 and the control impulse from pressure controller 21 in line 25 has been admitted to positioning actuator 10 of the combination quick-opening and control valve 8, the value of this impulse having already been equivalent to the preset flowrate impulse as described above for the working position. The pressure controller 21 on the medium pressure steam line is now functioning as operating controller while the multiplier relay 17 is disconnected under prevailing conditions. Instantaneous control and stabilization is safeguarded by the combination quick-opening and control valve 8 with its connection to the two change-over valves 14 and 18, as provided for by the invention, in conjunction with the flowmeter 5 and the pressure controller 21.

Figure 2:
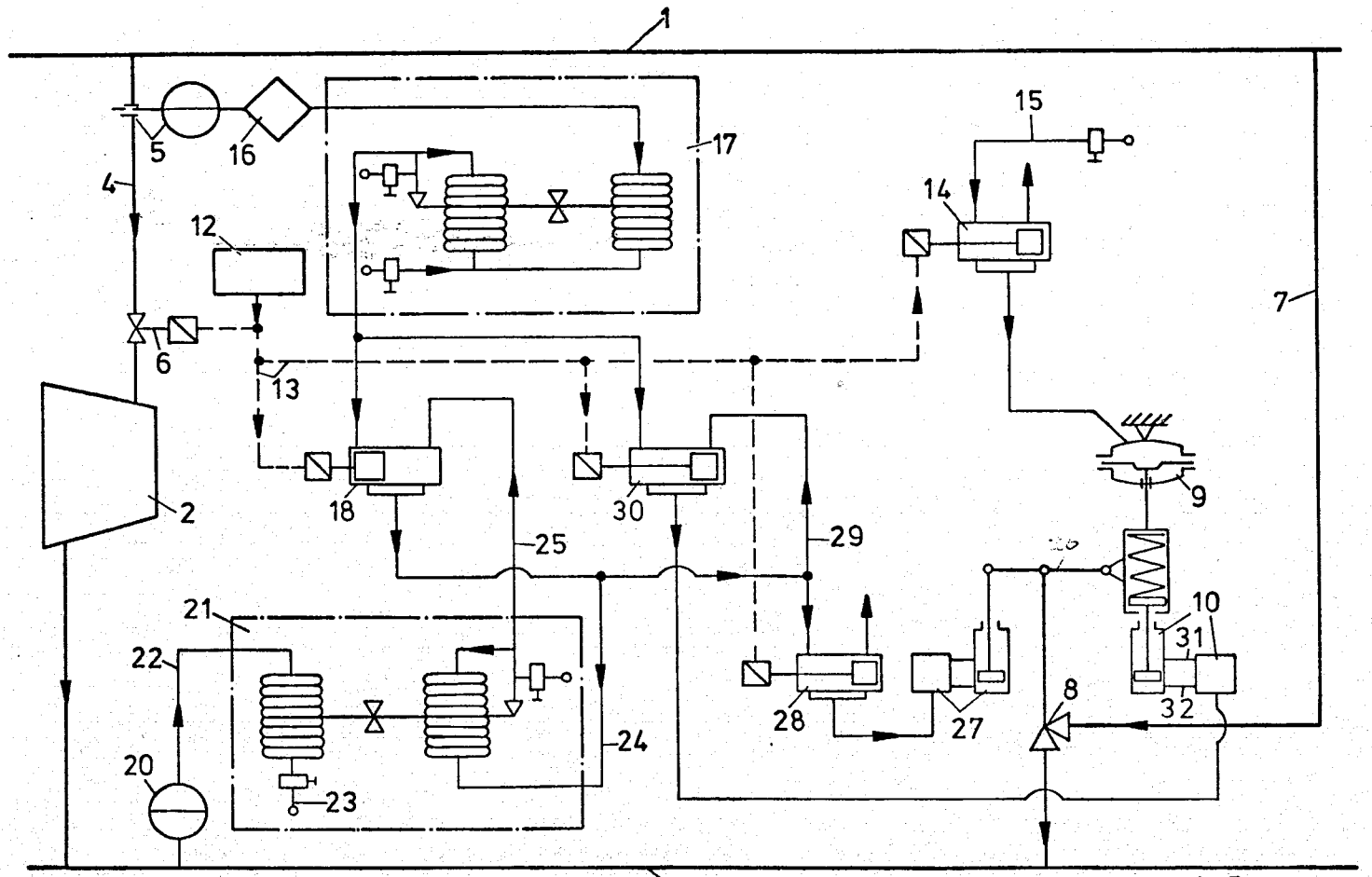
FIG. 2 is a diagram of the control system of FIG. 1 equipped with an automatic start-up control.

For the start-up of the integrated plant with the aid of the control system according to FIG. 1 it would be necessary to provide another line connected in parallel to the bypass line 7 between high-pressure steam line 1 and medium-pressure steam line 3 in order to be able to admit steam from the high-pressure line 1 into the medium-pressure line 3 by means of a valve installed on said line. It is another feature of the invention that this additional line with valve can be omitted because according to FIG. 2 the operating lever 11 of positioning actuator 10 of FIG. 1 is modified into operating lever 26 with two free ends, the second free end being connected to a positioning actuator 27. At start-up conditions, steam will pass into medium-pressure line 3 both from high-pressure line 1 through high-pressure turbine 2 and from bypass line 7. The steam flow passing through the combination quick-opening and control valve 8 into the bypass line 7 will be reduced, for example by manual control through the pressure controller 21 and the positioning actuator 27, as the steam flow through high-pressure steam turbine 2 is increased.

Positioning actuator 27 is connected to the change-over valve 28 which, in turn, is connected through a line 29 to an additional change-over valve 30. This additional change-over valve 30 is connected to the multiplier relay 17 as is the change-over valve 18. At start-up conditions, the pistons in the change-over valves are positioned to admit the control impulse from multiplier relay 17 through the change-over valve 30 to the positioning actuator 10 where it is stored as initial spring stress. The control impulse from the pressure controller 21 is the same in lines 24 and 25 and acts through the line 29 and the positioning actuator 27 upon the operating lever 26 to produce proportional opening of the valve. Pressure controller 21 can be set to hand or automatic operation. In the event of a steam turbine failure at start-up conditions, the stored initial stress of the spring of positioning actuator 10 causes further opening of the valve so that the actual flow of turbine steam may now pass also through the combination quidk-opening and control valve 8. By means of shut-off valves (not shown on the drawing) in lines 31 and 32 connected to the positioning actuator 10, the piston is made inoperative in case of disturbances.

Provided that no failure occurs during start-up and provided further that the rated steam flow passes solely through the turbine 2 into the medium-pressure steam-system — i.e. the combination quick-opening and control valve is in the closed position — positioning actuator 27 is held in its end position through the change-over valve 28 while the positioning actuator 10 is connected through the reset change over valves 30 and 18 to the multiplier relay 17 and pressure controller 21. The control system is now in its working position as described for FIG. 1 and will operate in the same way in case of disturbances.

If an integrated plant comprises several high-pressure steam consumers arranged between the high-pressure line 1 and the medium pressure steam line 3, the present invention provides for a control system that remains in extremely stable condition despite a minimum of bypass lines and combination quick-opening and control valves.

What we claim is:

1. A control system for steam flowrate and steam pressure on a connecting line serving as a bypass between the high pressure and medium pressure steam lines in a steam system including a feed line between the high and medium pressure lines to one or more steam turbines comprising in combination, 1. a flowmeter with root extracting relay in the steam turbine feed line,
2. a pressure controller in the medium pressure line,
3. a combination quick opening and control valve having an operating lever mounted on a fixed fulcrum, said valve being interposed between said high and medium pressure steam lines,
4. a hold-down operator for said valve acting against said operating lever,
5. a spring biased positioning actuator operatively associated with said hold-down operator,
6. a change-over valve connecting said hold-down operator to a working pressure system,
7. a branch line leading from said positioning actuator,
8. a second change-over valve connected to said branch line,
9. a pressure controller having an outlet connected to said branch line,
10. a connecting line between said second change-over valve and another outlet of said last pressure controller,
11. a multiplier relay in the steam turbine feed line,
12. a line connecting the outlet of said multiplier relay and said second change-over valve, and
13. said first and second change-over valves being actuated through the turbine trip system.

2. A control system as claimed in claim 1, comprising a second positioning actuator having an operating piston rod, an operative connection between said piston rod and one end of said operating lever of the combination quick-opening and control valve, and an operative connection between the opposite end of said operating lever and said hold-down operator.

3. A control system as claimed in claim 2, comprising a valve stem for said combination quick-opening and control valve, and a pivotal connection between said valve stem and the center of said operating lever.

* * * * *